United States Patent [19]

Azuchi et al.

[11] Patent Number: 4,962,919

[45] Date of Patent: Oct. 16, 1990

[54] BILL HANDLER

[75] Inventors: Isamu Azuchi, Hiratsuka; Hiroshi Fujikura, Yokohama; Yoshinobu Haruna, Fujisawa; Ryuichi Onomoto, Kusatsu; Masato Nishikawa, Kyoto, all of Japan

[73] Assignee: International Business Machines Corp. & Omron Tateisi Elec., Japan

[21] Appl. No.: 308,774

[22] Filed: Feb. 10, 1989

[30] Foreign Application Priority Data

Feb. 13, 1988 [JP] Japan ..... 63-31709
Feb. 15, 1988 [JP] Japan ..... 63-32579

[51] Int. Cl.[5] ..... B65H 3/06

[52] U.S. Cl. ..... 271/3.1; 271/9; 271/299

[58] Field of Search ..... 271/3.1, 9, 3, 279, 271/299; 209/534; 414/789.6, 789.9

[56] References Cited

U.S. PATENT DOCUMENTS 4,342,325 8/1982 Lundblad ..... 271/3.1
4,428,501 1/1984 Osako ..... 271/9 X
4,552,350 11/1985 Nagy ..... 271/3.1 X
4,577,763 3/1986 Placke ..... 271/9 X
4,618,302 10/1986 Kokubo ..... 271/212 X
4,625,870 12/1986 Nao ..... 271/9 X
4,746,110 5/1988 Chiba ..... 271/3.1

FOREIGN PATENT DOCUMENTS 3115001 3/1982 Fed. Rep. of Germany .
2605993 6/1988 France .
2161143 1/1986 United Kingdom .

*Primary Examiner*—Richard A. Schacher
*Attorney, Agent, or Firm*—Dickstein, Shapiro & Morin

[57] ABSTRACT

A bill handling apparatus which has a bill discharge outlet (13) for discharging instructed kinds of and instructed number of bills and which is to be shared between two tellers respectively located on the right and left sides thereof is provided with at least two receive members (42, 43) disposed in the left and right portions. The members are movable in the forward and backward directions and are used to receive discharge bills. If the teller who receives the discharged bills is on the left side, the receive member on the right side is proceeded; whereas, if the teller who receives the discharged bills is on the right side, the receive member on the left side is advanced. As a result, the bills discharged onto the receive members are inclined toward the left or right, which enables the teller on the left or right side to easily take out the bills.

8 Claims, 11 Drawing Sheets

BILL HANDLER

BACKGROUND OF THE INVENTION

1. Field of the Invention

The present invention relates to a bill or bank note handler, and in particular to a bill deposit and dispense machine to effect bill deposit and dispense operations which is installed in a bank at an inner position with respect to a counter so as to be commonly used by two tellers on the right-hand and left-hand sides of the bill handler.

In this specification, the bill handler includes a bill deposit machine, a bill dispenser, and a bill deposit and dispense machine.

2. Description of the Prior Art

For a bill deposit and dispense machine shared between two clerks, these tellers respectively take positions at the right and left sides thereof. Since the bill deposit and dispense machine possesses only one bill discharge or eject outlet, it is sometimes difficult to determine which teller should receive the discharged or ejected bills, in addition, there has been a problem that the discharge outlet generally disposed at the center of the bill deposit and dispense machine is far away from the positions of the respective tellers and hence it is not easy to take out the discharged bills.

As a bill discharge operation and a structure associated therewith to solve the problems above, there have been known those shown in FIGS. 12*a* to 12*d*.

In the configuration of FIG. 12*a*, there are disposed display lamps 91*a* and 91*b* in the right-hand and left-hand portions of the bill discharge outlet 90. When a bill A is discharged to the outlet 90, the display lamp 91*a* or 91*b* is turned on in association with a teller working with the bill handler. Since the teller to receive the ejected bill is indicated by use of the dislay lamp thus turned on, the clerks working at the machine are required to pay attention thereto, which imposes psychological loads on the clerks; in addition, there are disposed only simply display items and there is not provided any concrete countermeasure to prevent a mistake in the bill handling operation; consequently, bills are often mishandled by these machine operators.

The structure of FIG. 12*b* is described in the Japanese Patent Publication No. 60-54712. In this device, mask plates or barriers 92*a* and 92*b* are disposed at the right and left sides of the discharge outlet 90 so as to be slidable in the backward and forward directions. One of the mask plates on the side of the teller not using the bill deposit and dispense machine is set to the projected state so as to prevent the operator from taking out the bills. According to this structure, in order to effectively avoid the wrong operation, the size of the mask plates 92*a* and 92*b* is required to be increased, which deteriorates the quality of the design of the machine. In addition, since the bills are ejected toward the forward direction, it is not easy for the teller to take out the bills from the right or left positions.

In the configurations of FIGS. 12*c* and 12*d*, a bill discharge outlet 90 from which bills are ejected toward an upward direction is provided with a guide member 93 so as to develop a swing motion. This guide member 93 is allowed to tilt toward the clerk using the machine. This enables the pertinent clerk to easily take out the bills and prevents the other clerk not using the machine from taking out the bills. However, since the guide member 93 is disposed to project upward in any situation, the quality of the design is deteriorated.

On the other hand, as for the bill inlet of the bill deposit and dispense machine, since two tellers share one inlet, while a teller is handling a transaction by use of the machine, the other teller cannot operate the machine and hence is required to check the operation of the teller until the operation of the machine is completed, which imposes a heavy load in a busy period of time and which prevents the operator from concentrating on the transaction job.

In addition, in a case where one of the tellers continuously carries out depositing transactions, before the preceding transaction is finished, the succeeding transaction cannot be started; moreover, since the deposit operation is to be achieved after the preceding transaction is completed, there is a period of time which is unused, which consequently lowers the efficiency of the operation.

SUMMARY OF THE INVENTION

It is therefore an object of the present invention to provide a bill handling apparatus having a bill discharge outlet to be shared between two operators located at the right and left sides thereof wherein the mistake of bill handling is prevented, the bills are easily taken out therefrom, and the quality of design is not deteriorated.

Another object of the present invention is to provide a bill deposit and dispense machine which reduces a wait time to insert bills in a consecutive deposit operation so as to enable the deposit operation to be achieved at a high speed.

The present invention is characterized in that there are provided, in a bill handling machine having a bill discharge outlet to eject bills according to the instructed types of notes and the instructed numbers thereof, at least two receiver members disposed at the right and left positions to receive ejected bills, said members being movable in the forward and backward directions; means for inputting an indication to specify whether the operator to receive the ejected bills is at the right or left position, and receiver drive means for driving, in response to the right or left position data supplied from said input means, one of said receiver members at a position opposite to the specified position so as to set the receiver to a proceeded position.

When the operator to receive the ejected bill is at the left side, the receiver member on the right side is driven, and when the operator to receive the discharged bill is at the right side, the receiver member on the left side is driven as described above. As a result, the ejected bills are tilted toward the left or right, which enables the operator at the left or right side to easily take out the bills. In addition, for the other operator, the proceeded receiver member functions as a mask plate or barrier, which hence prevents a wrong bill handling operation from being conducted by mistake. Furthermore, since the receiver members are retracted in ordinary cases, the high quality of design can be preserved.

Moreover, according to the present invention, there is provided a bill handling apparatus including a bill insert inlet to receive bills to be deposited, a fetch mechanism to fetch the bills inserted from the inlet, a temporary reserve mechanism to temporarily reserve the received bills, and a cartridge to store the bills thus temporarily reserved characterized in that said apparatus further including means for prohibiting an insertion of bills into said inlet from when bills are inserted thereinto to when the bills are fetched by said fetch meachanism and are reserved in said temporary reserve mechanism, means for removing the prohibition when the bills are reserved in said temporary reserve mechanism, and means for reporting the removal of the prohibition.

When bills inserted into the inlet are reserved in the temporary reserve mechanism, the insertion prohibition of the next bills is removed, and the removal is notified. In consequence, the teller is allowed to insert bills into the inlet for the next transaction. This frees the teller from waiting for the next transaction operation with bills being held in his hand. Since the removal of the prohibition is reported, the clerk to achieve the next transaction need not check for the completion of the previous transaction, which minimizes the load imposed on the clerk. When the preceding transaction is finished, the bills for the subsequent transaction are beforehand installed in the inlet, an operation to fetch the bills can be immediately accomplished, which enables the period of time required for the transaction processing to be reduced.

BRIEF DESCRIPTION OF THE DRAWINGS

The present invention will be apparent from the following detailed description taken in conjunction with the accompanying drawings in which:

FIGS. 6 to 8 are diagrams showing in detail a bill discharge outlet in which FIG. 6 is a plan view, FIG. 7 is a longitudinal cross-sectional view, and FIG. 8 is a vertical cross-sectional view;

DESCRIPTION OF THE PREFERRED EMBODIMENTS

Figure 1:
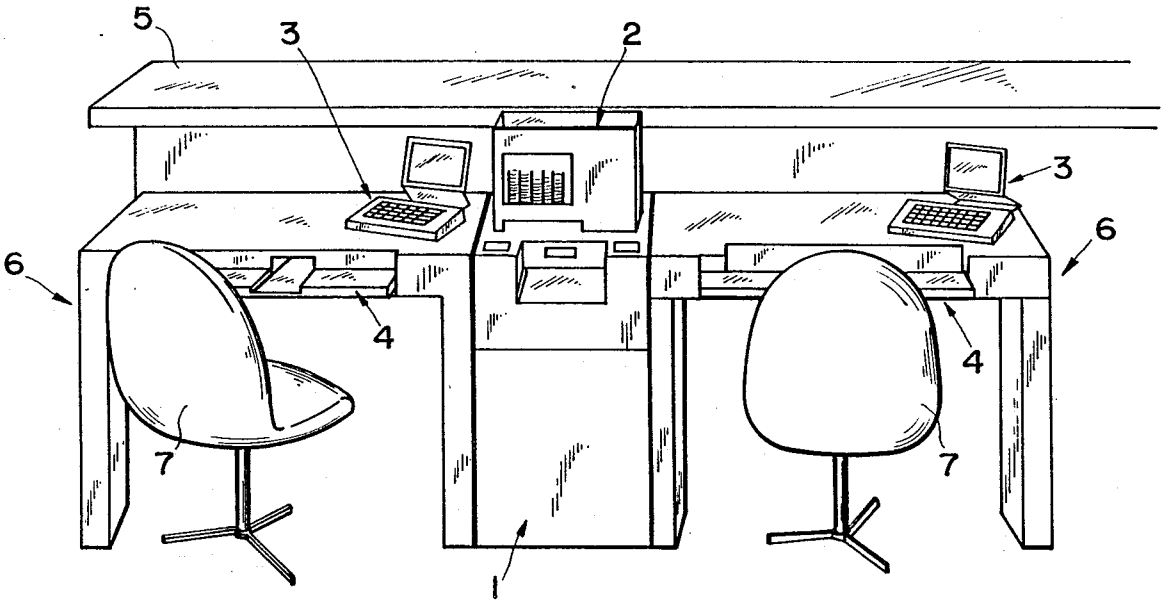
FIG. 1 is a perspective view showing the overall configuration of a transaction processing system.

FIG. 1 shows an appearance of an example of a system installed at a counter of a bank for tellers to execute transactions such as the depositing, withdrawal, and transfer operations.

On the inner side with respect to a counter 5, there are prepared two desks 6 and two chairs 7 for two clerks. A bill deposit and dispense machine 1 is located betwee these desks 6. The bill deposit and dispense machine 1 acheves operations including the identification of inserted bills, counting thereof, storage of the bills in a cartridge, retrieval of bills therefrom for a withdrawal transaction, identification of the bills, counting thereof, and discharge of the bills. A coin handler 2 is disposed on the bill deposit and dispense machine 1. The coin handler 2 accomplishes processing of coins, which is similar to that effected by the bill deposit and dispense machine 1 for bills. The bill deposit and dispense machine 1 and the coin handler 2 are shared between two tellers.

A terminal 3 is installed on the top surface or plate of each table 6. The terminal 3 includes a keyboard and a display so as to achieve operations such as input operations of an account number and an amount of a transaction and display operations of these input data items and other transaction data. The top plate of the desk 6 is integrally formed with a passbook (bankbook) handler 4. The passbook handler 4 is provided with devices such as a magnetic head which reads data of an account number or the like recorded on a magnetic stripe fixed on a surface of a passbook inserted into a passbook insertion inlet and a print head which prints transaction data onto the passbook.

The bill deposit and dispense machine 1, the coind handler 2, the terminals 3, and the passbook handlers 4 are connected via communication lines to a controller, not shown, said controller including components such as a computer and a memory. The controller is further linked to a host computer, not shown, of a control center through a telephone line, a dedicated communication line, and the like.

Figure 2:
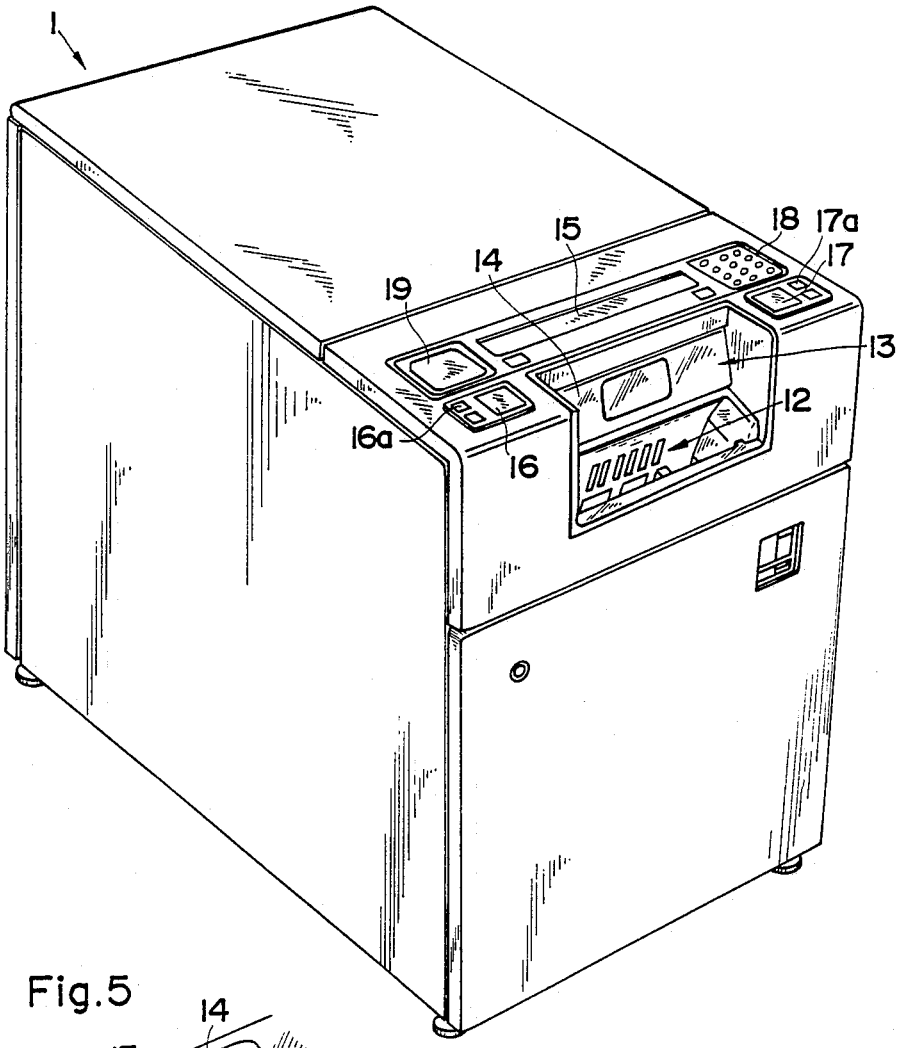
FIG. 2 is a perspective view showing an appearance of a bill deposit and dispense machine.

FIG. 2 shows an appearance of the bill deposit and dispense machine 1. The bill deposit and dispense machine 1 is provided in an upper portion of the front side thereof with a bill insertion inlet 12 and a bill discharge outlet 13. The discharge outlet 13 is provided with a shutter 14. On the right and left sides of the shutter 14, there are disposed start keys 16 and 17 for the tellers to start deposit and discharge operations of the bill deposit and dispense machine 1. In the vicinity respectively of the start keys 16 and 17, there are disposed display lamps 16*a* and 17*a*, which respectively indicate that the pertinent keys 16 and 17 are depressed. In addition, on the upper surface in the front section of the bill deposit and dispense machine 1, there are arranged a display 15 for displaying various messages, a ten-key pad 18 for executing a mode setting, a test, and the like, and a diplay panel 19 for displaying a location of a jamming of bills in the machine 1.

Figure 3:
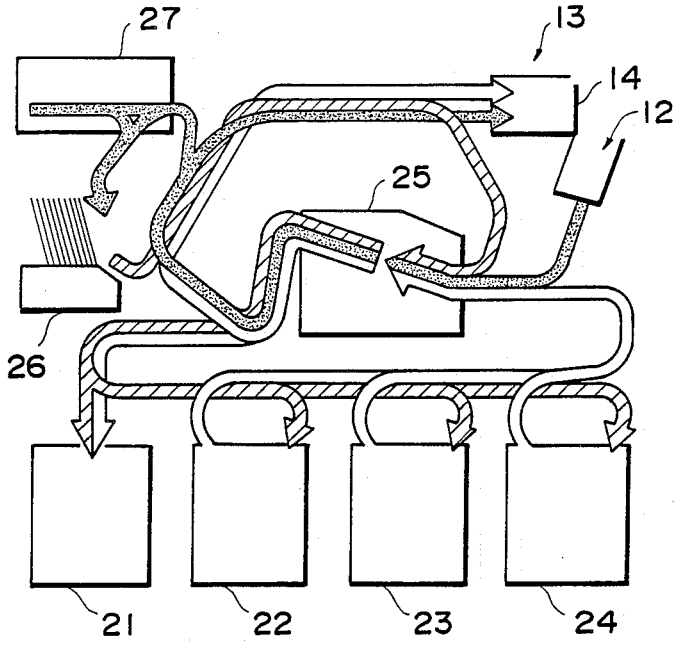
FIG. 3 is a schematic diagram showing a flow of bills in the bill deposit and dispense machine.

FIG. 3 shows a flow of bills in the bill deposit and dispense machine 1. In this machine 1, there are disposed a bill recollection box 21, bill cartridges 22 to 24 for storing bills by bill types, a bill identifying unit (bill checker) 25 for identifying the type of each bill and for judging the truth or falsehood therof, a temporary reserve unit 26 for temporarily reserving bills, and a bill turning section 27 for turning any bill placed upside down so as to arrange the bills.

The bills inserted into the inlet 12 for an operation such as a depositing transaction are delivered in a sheet-by-sheet fashion through a conveying path to the identifying unit 25, which then judges for the truth or falsehood of the bill, identifies the type of the bill, and checks the arrangement of the bill to determine whether or not the bill is upside down. The bill judged to be true is conveyed to the temporary reserve unit 26 so as to be temporarily stored therein. If the bill turning operation is required, the bill is turned in the bill turning section 27 and is then passed to the temporary reserve unit 26. A bill for which the judgement is impossible (inlcuding a broken bill and a bill which is to dirty to be judged) and a bill judged to be false are returned from the identifying unit 25 to the eject outlet 13. When a transaction such as a depositing transaction is completed, the bills in the temporary reserve unit 26 are again judged for the kinds thereof by the identifying unit 25 so as to be stored in the cartridge 22 to 24 depending on the judged bill types. The bills for which the judgement of the kinds is impossible and the bills which are judged to be true and are too much damaged for the judgement are recollected in the recollection box 21.

In a withdrawl operation or the like, when the amount to be delivered as well as the kinds and number of bills to be discharged are respectively determined according to the amount, the determined number of bills are resepctively fed from the cartridges 22 to 24 so as to be sequentially supplied to the identfying unit 25. The kinds of bills are again checked in this unit 25 and are then ejected to the outlet 13. The bills for which the judgement of the kinds is impossible and the bills which are judged to be true and are too much damaged for the judgement are recollected in the recollection box 21.

Description will be briefly given of the operation of the transaction processing system and the depositing and withdrawal transactions.

In a case of a depositing transaction, the clerk inputs data indicating a depositing transaction from a keyboard of the terminal 3. In addition, the clerk installs a passbook received from the customer in the passbook handler 4, which in turn reads magnetic stripe data of the passbood. The data inputted from the terminal 3 and the passbook data read by the passbook handler 4 are sent to the controller. In response to an instruction from the controller, the bill deposit and dispense machine 1 is set to the standby state. The clerk inserts the bills received from the customer into the inlet 12 of the machine 1 and then depresses the start key 16 or 17 (either key which is near the clerk operating the machine 1). The bill deposit and dispense machine 1 then initiates the operation thereof, namely, the bills inserted are checked for the identification and are counted such that only the acceptable bills are reserved in the temporary reserve unit 26 and then the total amount thereof is displayed on the display 15 and is sent to the controller. The clerk makes an inquiry to the cuctomer for a confirmation of the displayed amount. If the customer approves the amount, the clerk pushes the confirmation button (in this embodiment, the start key 16 or 17 is also used for this purpose). The depression of the confirmation button is reported to the controller. Since the controller transmits the passbook data (such as the account number) and the amount to the host computer of the center, the amount is added, through the operation of the host computer, to the balance of the customer (associated with the account number) in the file. When the confirmation button is depressed, the bills reserved in the temporary reserve unit 26 are transferred to the cartridges 21 to 24. This operation sets the bill deposit and dispense machine 1 to the standby state in which the next depositing and withdrawal transactions can be processed.

In a withdrawal or payment transaction, the teller inputs an indication specifying a withdrawal operation through the terminal 3 and then installs the passbook in the passbook handler 4, which in turn reads passbook data. The input data from the terminal 3 and the data read by the passbook handler 4 are sent to the controller. The clerk further operates the terminal 3 to key in an amount to be paid and then the amount data is delivered to the controller. The controller instructs the bill deposit and dispense machine 1 to discharge bills corresponding to the amount. In addition, since the clerk depresses the start key 16 or 17, in response thereto, the bills of the amount above are fed from the cartridges 22 to 24 in the machine 1 so as to be discharged into the outlet 13 and then the shutter 14 is opened. When the clerk takes out the bills from the outlet 13, the condition is sensed by a sensor and then the shutter 14 is accordingly closed. Naturally, communications are effected between the controller and the host computer of the center such that the amount of the payment transaction is subtracted from the balance of the customer in the file, thereby updating the balance of the customer.

Figure 4:
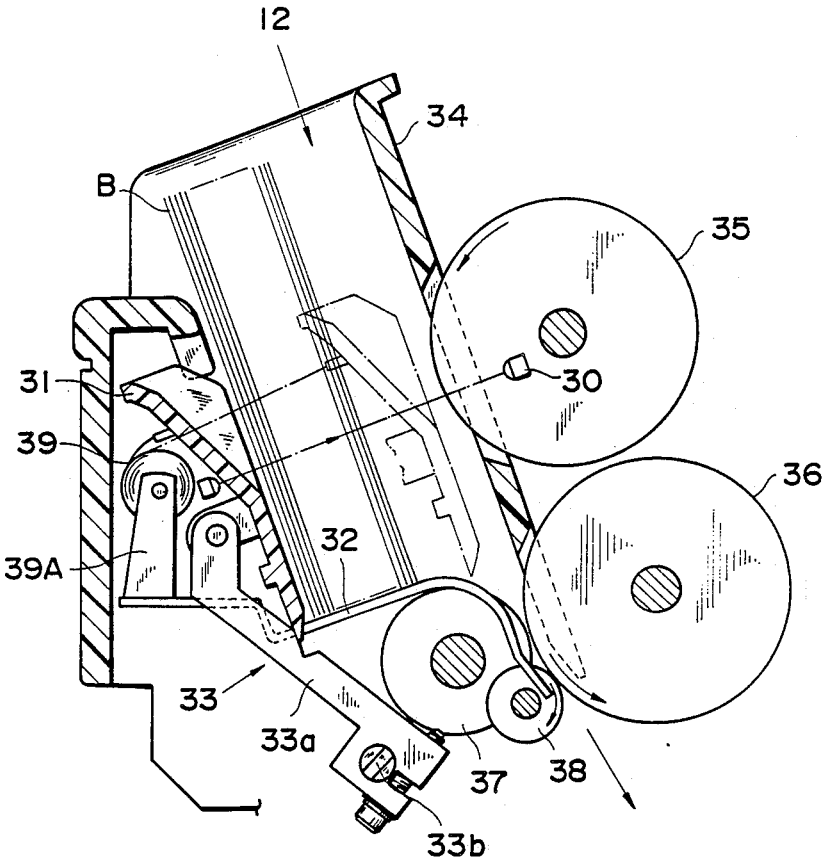
FIG. 4 is a cross-sectional view showing details of a bill inlet.

FIG. 4 shows configurations of the bill insert inlet 12 and the bill fetch unit disposed therein.

The bill insert inlet 12 is defined by a bottom plate 32, a receive plate 34, and a movable push plate 31 opposing thereto. A bill or a plurality of bills B is or are inserted into a location between the receive plate 34 and the push plate 31 so as to lean on the push plate 31 in a slightly inclined state. The push plate 31 is moved by means of a push mechanism 33 from a ready position indicated by a solid line to a push position indicated by a broken line (the push position varies depending on the number of bills B). The push mechanism 33 includes a lever **33*a* to keep the push plate 31 and a rotation shaft 33*b* to which an end of the lever 33*a* is fixedly secured, and the rotation shaft 33*b*** is rotated by a drive unit, not shown.

The receive plate 34 is provided with a window therethrough, and an upper fetch roller 35 is arranged therein such that a portion of the roller 35 is projected into the inlet 12. Similarly, in a bill fetch inlet below the insertion inlet 12, there are disposed a lower fetch roller 36, a friction roller 37 to be brought into contact with the roller 36, and a pinch roller 38.

The bills B inserted into the inlet 12 are pushed against the receive plate 34 and the fetch roller 35 by means of the push plate 31 moved to the push position. When the fetch rollers 35 and 36 and the pinch roller 38 are rotated, the bills are fed toward the downward direction in a sheet-by-sheet manner beginning from the first bill. The friction roller 37 is disposed to prevent the second bill from being delivered together with the first bill. Namely, the second bill is retained so as to be separated from the first bill.

Figure 5:
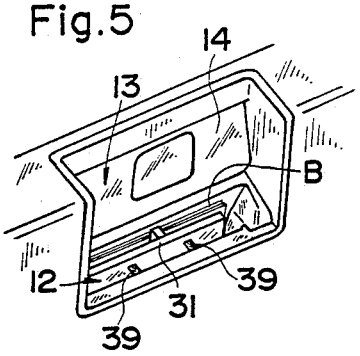
FIG. 5 is a perspective view showing a state in which a bill insertion is prohibited in the inlet.

Two coil springs 39 each are attached at an end thereof to a retaining plate 39A fixed on the bottom plate 32. The other end thereof are attached on a rear surface of the push plate 31. In order to fetch the bills B installed in the inlet 12, when the push plate 31 is moved to the push position, the coil springs 39 are drawn as indicated by a broken line in FIG. 4 and as shown in FIG. 5 such that the drawn portions thereof cause the upper opening of the inlet 12 to be closed. This prevents, during a bill fetch operation, bills for the next transaction from being installed into the inlet 12.

In addition, the bill insert inlet 12 is provided with a sensor 30 for sensing the bills installed into the inlet 12. The sensor 30 is, for example, a photoelectric sensor including a light emitter and a light receiver.

Figure 6:
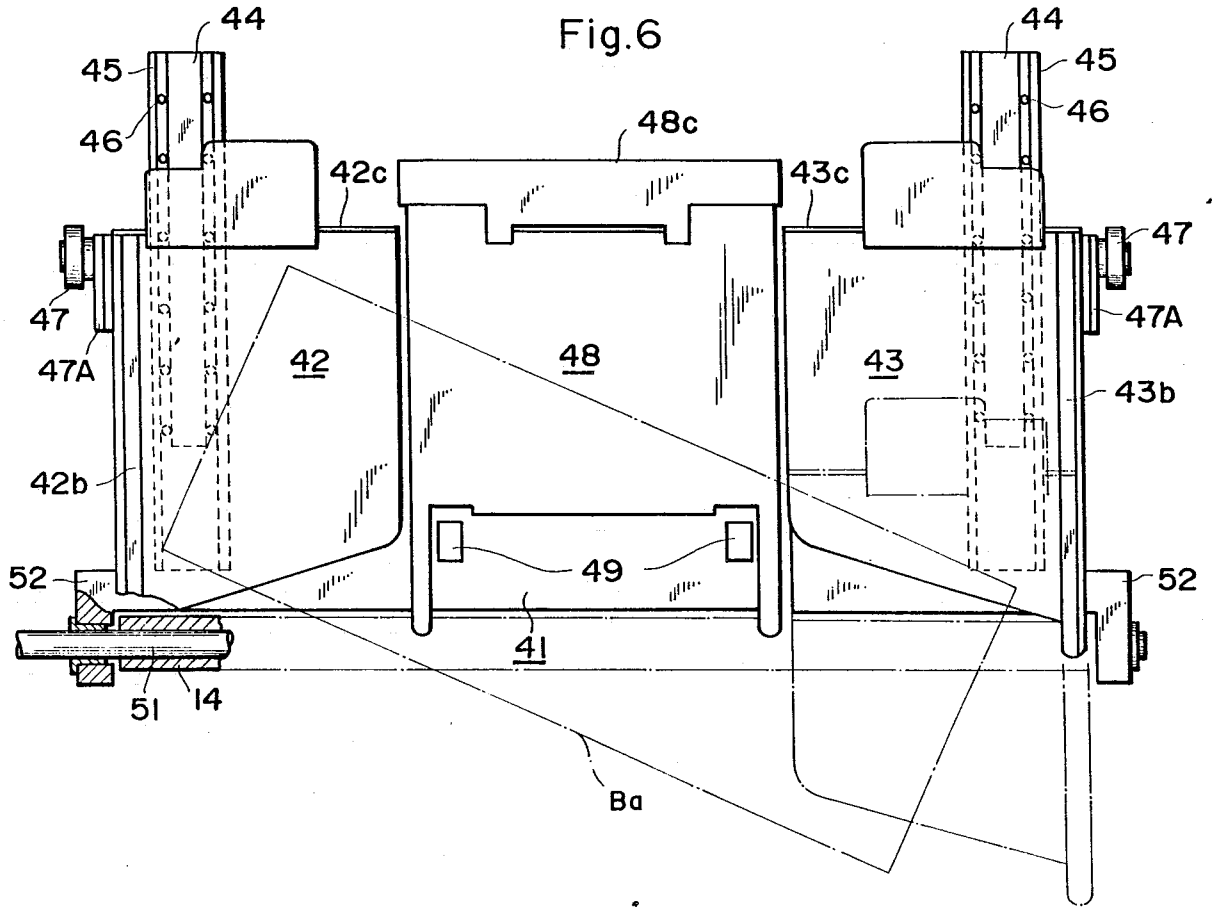
Figure 7:
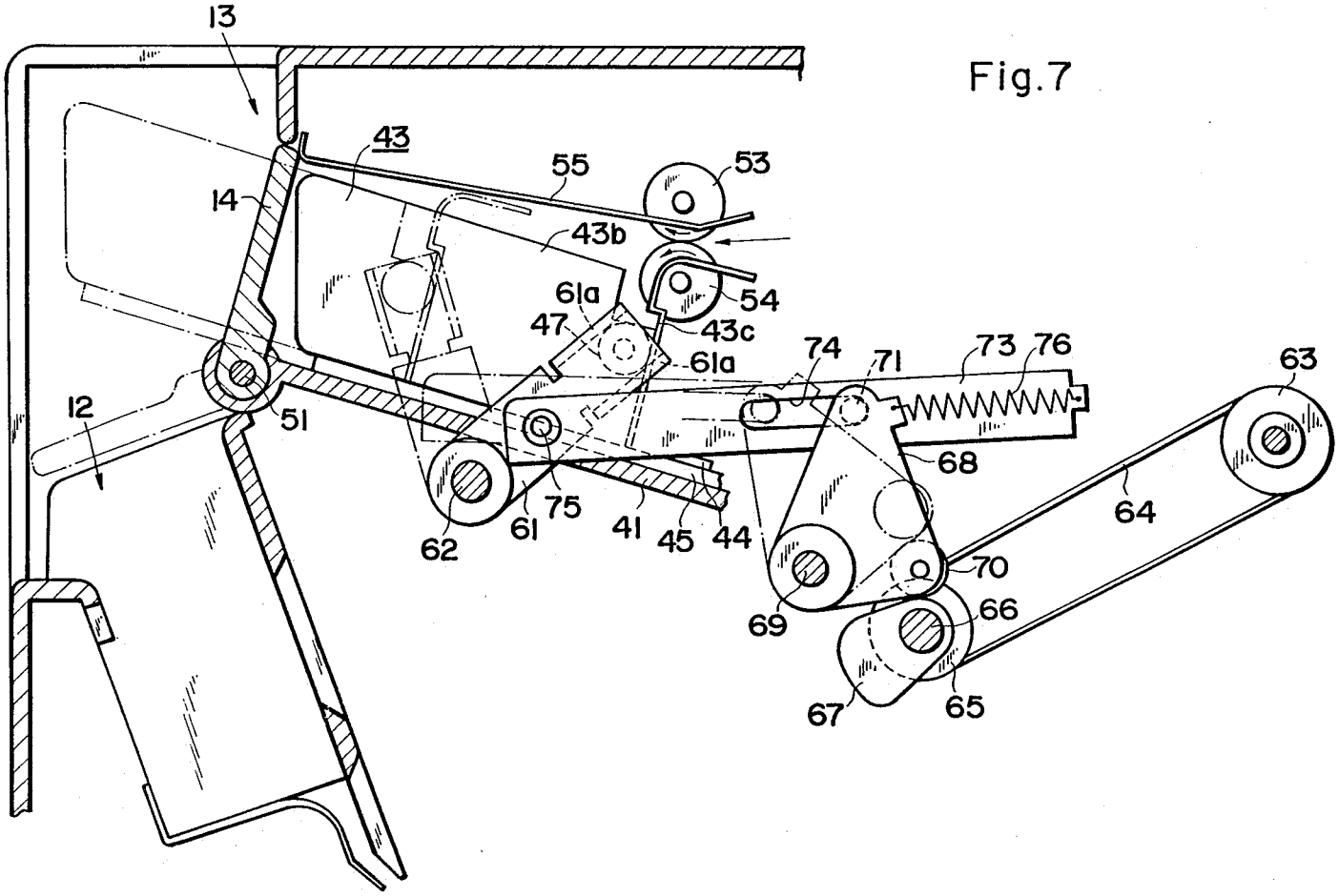
Figure 8:
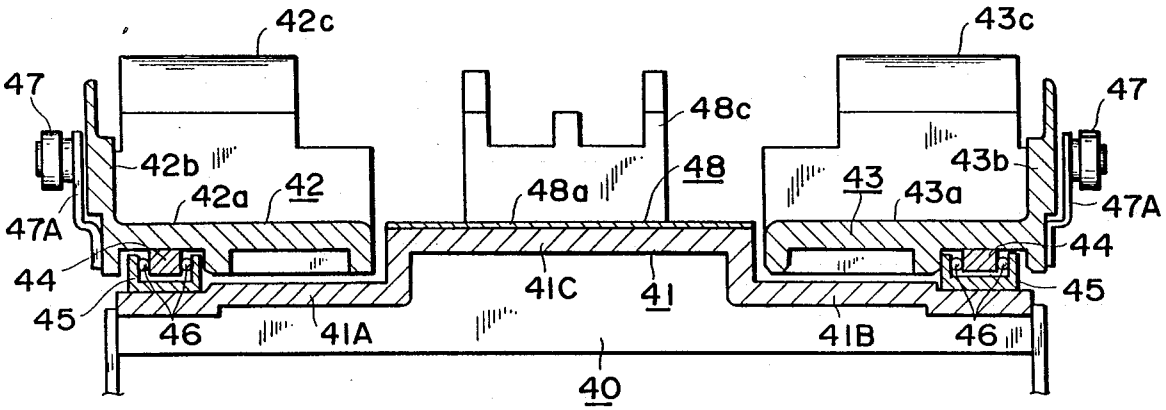

FIGS. 6 to 8 show a bill discharge outlet and bill discharge mechanisms disposed therein.

At the position of the outlet 13, a receive base 41 is fixedly secured on a frame 40. The receive base 41 includes a central portion 41C projecting upward in a cross-sectional plane of FIG. 8. The central portion 41C and left and right portions 41A and 41B respectively have flat upper surfaces. The receive base 41 is inclined upward in the forward direction.

On the left and right portions 41A and 41B of the receive base 41, there are disposed receive members 42 and 43 so as to be movable in the forward and backward directions. That is, the receive 42 and 43 respectively include bottom plates 42a and 43a, outer side walls 42b and 43b, and rear walls 42c and 43c. On the bottom surfaces of the bottom plates 42a and 43a, there are fixed a slide member 44, which extends in the forward and backward directions. On the other hand, in the right and left portions of the receive base 41, there is fixedly secured a rail 45 which extends in the forward and backward directions and which has a U shape in a cross-sectional plane thereof such that the rail 45 recieves via balls 46 the slide member 44 to be slidable thereon. A drive mechanism to proceed and to retract these receive members 42 and 43 will be described later. On the outer sides of the side walls 42b and 43b respectively of the receive members 42 and 43, there are rotably attached a roller 47 by means of an arm 47A.

The central portion 41C of the receive base 41 is used as a receive section 48 on which there are disposed a bottom plate 48a and a rear wall 48c. In addition, the receive section 48 is provided with a bill removal sensor 49 which senses a removal of bills discharged onto the receive section 48 and the receive members 42 and 43. The sensor 49 also includes a photoelectric detector.

In a terminating portion of the conveying path of the discharged bills, namely, at a portion to connect the path to the eject outlet 13, there are disposed discharge rollers 53 and 54 such that the bills are passed between the rollers 53 and 54 so as to be delivered onto the receive members 42 and 43 and the receive section 48. Above the receive members 42 and 43 and the receive section 48, there is disposed a guide plate 55 to prevent the discharged bills from moving toward the upward direction.

The shutter 14 is fixedly secured at a base thereof to the rotation shaft 51, which is in turn rotably received by a bearing 52 disposed on the receive base 41. When the rotation shaft 51 is rotated by a shutter open and close drive mechanism, not shown, the shutter 14 is moved from the closed position of the outlet indicated by a solid line in FIG. 7 to the open position marked by a broken line. Furthermore, when the rotation shaft 51 rotates in a reverse direction, the shutter 14 is restored from the open position to the closed position. At the open position indicated by a broken line, the shutter 14 closes the upper opening of the inlet 12. As a result, in a bill discharge operation, an insertion of bills into the inlet 12 is prohibited.

For the receive members 42 and 43 respectively disposed on the left and right sides, there are respctively provided proceed and retract drive mechanisms, which are completely of the same constitution, and hence the mechanism of the receive member 43 on the right side will be specifically described with reference to FIG. 7.

A lever 61 is rotably supported at an end thereof to a shaft 62 fixed onto the frame 40; whereas, at the other end of the lever 61, there is formed a guide section including two rising side walls 61a. The roller 47 disposed in the receive member 43 movably engage with these walls 61a at a position therebetween.

On the other hand, between a pulley 63 to be rotated by the drive motor, not shown, and a pulley 65 fixed onto a rotation axis 66, there is applied a belt 64 therebetween. A cam 67 is fixedly secured on the rotation shaft 66. A triangle-shaped plate 68 is rotably supported at a position of a vertex thereof on a shaft 69 fixed onto the frame 40. At other vertex position of the plate 68, there is rotably attached a cam floor 70 such that the plate 68 is energized by a spring 76 so as to bring the cam floor 70 into contact with the cam 67 in any situations. A pin 71 is rotably mounted on further other vertex of the plate 68.

A lever 73 is linked at an end thereof to substantially a center position of the lever 61 by means of a pin 75. In substantially a center portion of the lever 73 along a longitudinal direction, there is bored an elongated hole 74 extending in the longitudinal direction such that the pin 71 is movably installed in the elongated hole 74. Between the other end of the lever 73 and the plate 68, there is disposed the drawing spring 76, which energizes the pin 71 so as to be brought into contact with an end (at a position having a longer distance with respect to the pin 75) of the long hole 74 in any situations.

When the cam 67 is rotated about the shaft 66 by the drive motor, the plate 68 swings about the shaft 69 by means of the cam floor 70, which moves the lever 73 to the forward direction. In consequence, the lever shaft 61 swings about the shaft 62 so as to exert a force via the roller 47, thereby moving the receive member 43 toward the forward direction. In consequence, the receive member 43 proceeds to the position designated by the broken line. When a reverse rotation is developed by the drive motor, the receive membe 43 is returned to the original position indicated by the solid line.

In this fashion, the left and right receive members 42 and 43 are driven for the proceeding and retracting operations in an independent fashion. The receive base 41 is inclined toward the upward direction extending in the forward direction as described above, and the receive members 42 and 43 arranged thereon are also inclined. In consequence, the receive members 42 and 43 are inclined toward the upward direction extending in the forward direction.

As will be described later, the proceed and retract operations of the left receive member 42 and the open and close operations of the shutter 14 are consecutively accomplished, it is favorable to share the motor between the proceed and retract drive mechanism of the left receive member 42 and the open and close drive mechanism of the shutter 14 and to disposed a link mechanism therebetween (this is referred to a drive mechanism for the outlet of the right clerk). Similarly, the the proceed and retract drive mechanism of the right receive member 43 and the open and close drive mechanism of the shutter 14 are favorably associated with each other so as to share the motor therebetween (this is referred to a drive mechanism for the outlet of the left clerk).

Figure 9:
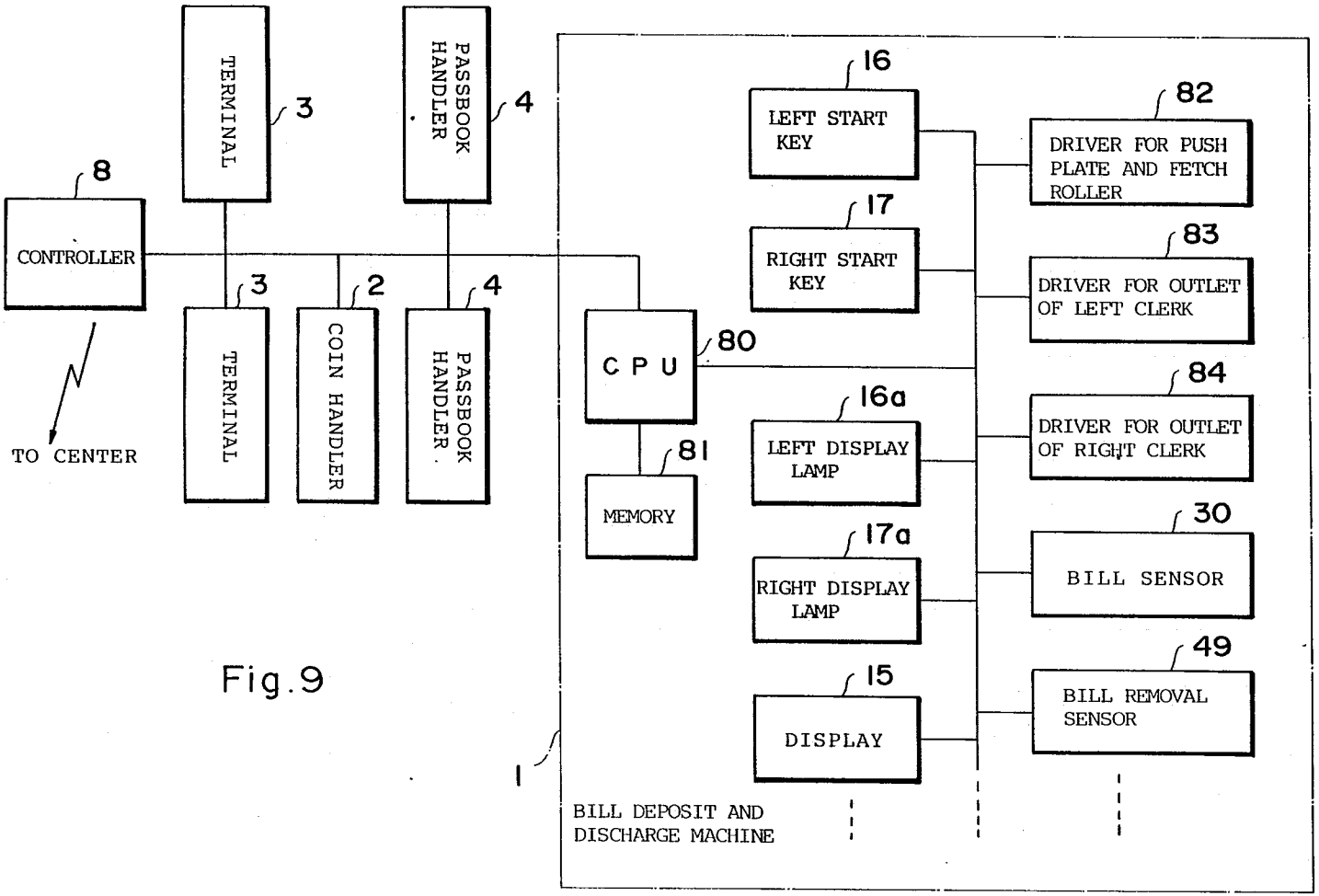
FIG. 9 is a block diagram showing an electrical constitution of the transaction processing system and the bill deposit and dispense machine.

FIG. 9 shows an overall electric constitution of the bill deposit and dispense machine 1 described above and a transaction processing system including the machine 1.

The bill deposit and dispense machine 1 comprises a central processing unit, CPU 80 for effecting the overall control operation. The CPU 80 is provided with a memory 81 in which an execution program and various data items are stored. The CPU 80 is connected to the left and right start keys 16 and 17, the display lamps 16a and 17a, the display 15, input/output devices such as a ten-key pad 18 arranged in the operator's panel, the drive mechanism 82 to proceed and to retract the push plate 31 and to rotate the drive roller 35 and the like, the outlet drive mechanisms for the left and right clerks 83 and 84 described above, the bill sensor 30 at the inlet 12, the bill removal sensor 49 at the outlet 13, and other mechanisms to convey bills such as the conveyor motor, the bill identifying unit 25, and various sensors in the conveying path.

The bill deposit and dispense machine 1, the coin handler 2, the terminals 3, and the passbook handlers 4 are connected to the controller 8, which is in turn linked to the host computer of the center as describec above.

Figure 10:
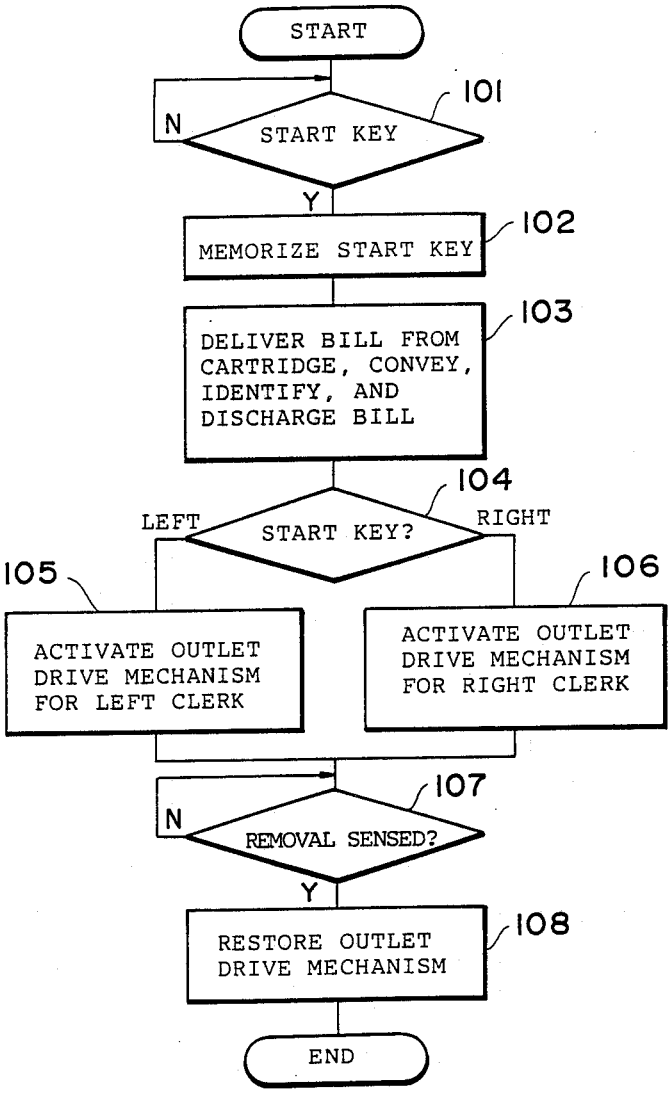
FIG. 10 is a flowchart showing a bill discharge processing.

FIG. 10 shows a bill discharge operation of the bill deposit and dispense machine 1, and in particular, a processing procedure of the CPU.

When either one of the left and right start keys 16 and 17 is depressed (step 101), the display lamp 16*a* or 17*a* corresponding thereto is turned on, and an event that either one of the left and right start keys 16 and 17 is depressed is stored in the memory 81 (step 102). When the left start key 16 is depressed by the teller on the left side, it is indicated that the bill deposit and dispense machine 1 is used by the left teller. When the right start key 17 is depressed, it is indicated that the clerk on the right side operates the bill deposit and dispense machine 1.

As described above, a bill feed operation of bills from the cartridges 22 to 24 in association with the kind of bills and the number thereof instructed from the controller and the identification of the bills in the identifying section 25 are conducted such that the bills to be discharged are sequentially accumulated in the left and right receive memebers 42, 43 and the receive section 48 of the outlet 13 (step 103).

When the bills of the specified amount are completely discharged, the data stored in the step 102 is referenced so as to check which one of the left and right start keys 16 and 17 is pressed in advance (step 104). For the depression of the start key 16 on the left side, the outlet drive mechanism for the left clerk 83 is activated (step 105). That is, the shutter 14 in the closed state is opened and the right receive member 43 is proceeded, which causes the bills accumulated on the receive members 42 and 43 and the receive section 48 to be inclined toward the left side as indicated by Ba in FIG. 6.

In consequence, the teller on the left side can recognize that the bills are discharged in response to an operation effected by the pertinent teller on the bill deposit and dispense machine 1; moreover, the teller on the left side is enables to easily handle the discharged bills.

In addition, for the clerk on the right side not using the bill deposit and dispense machine 1, it is difficult to take out the bills, which prevents the wrong bill handling operation from being conducted by mistake.

When the removal of the bills is sensed by the sensor 49 (step 107), the proceeded receive member 43 is retracted and the shutter 14 is closed (step 108).

In a case where the start key 17 on the right side is depressed, the shutter 14 is opened and the receive member 42 on the left is proceeded so as to naturally facilitate the removal of the bills for the clerk on the right side (step 106).

Incidentally, if a predetermined period of time is elapsed after the discharge of the bills and the bills are not removed, it is desirable that the proceeded receive member 42 or 43 is retracted and that the shutter 14 is closed. When the receive member is retracted and the shutter 14 is closed, the bills are restored from the inclined state to the original state (where the longitudinal direction thereof matches with that of the shutter 14).

Figure 11:
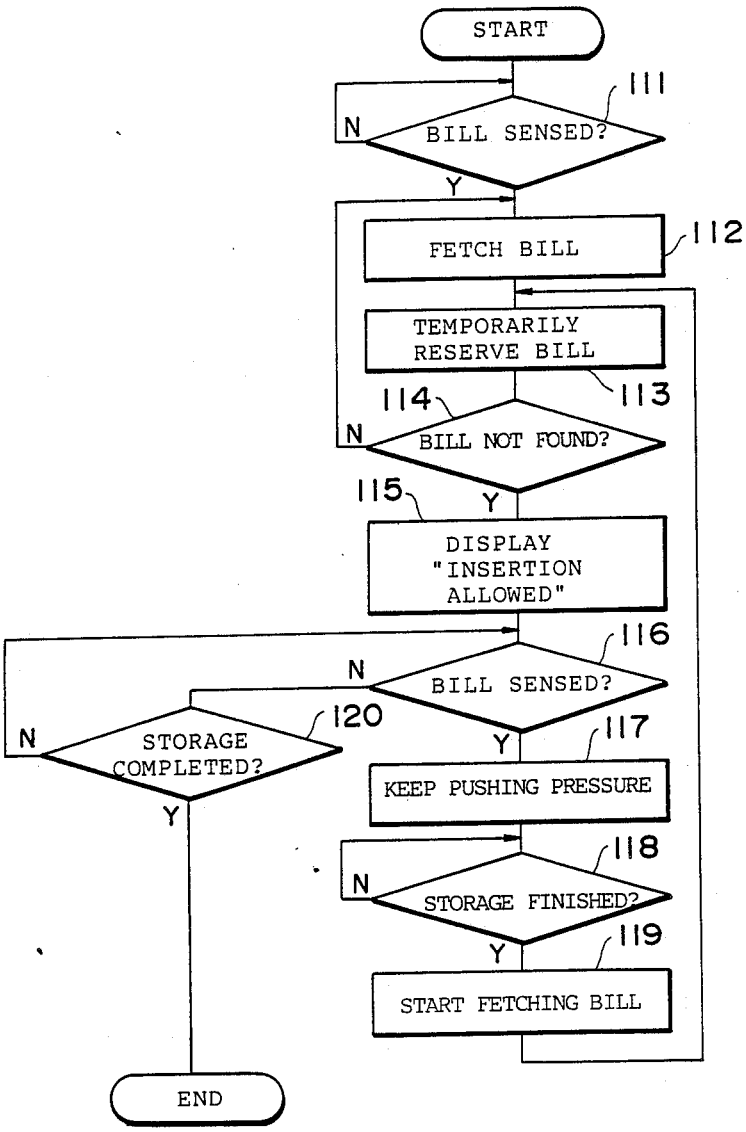
FIG. 11 is a flowchart showing a processing procedure to fetch inserted bills.
Figure 12A:
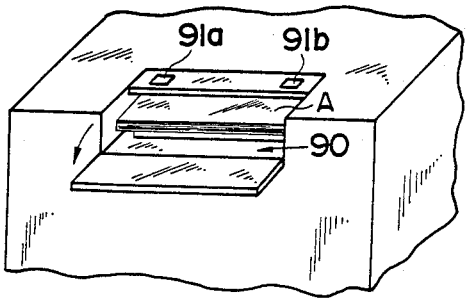
Fig.12a PRIOR ART
FIGS. 12*a* to 12*d* are perspective views showing structures of conventional bill discharge outlets.
Figure 12B:
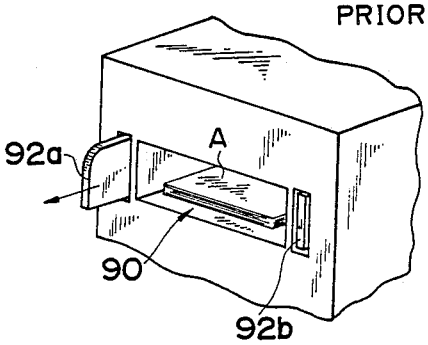
Fig.12b PRIOR ART
Figure 12C:
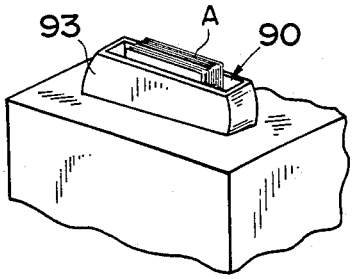
Fig.12c PRIOR ART
Figure 12D:
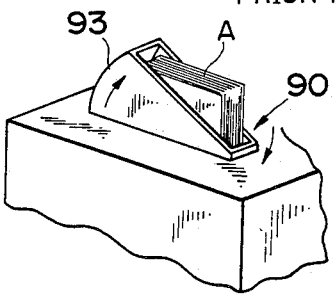
Fig.12d PRIOR ART

FIG. 11 shows a deposit processing operation of the bill deposit and dispense machine 1 and a processing procedure of the CPU 80.

For the depositing transaction or the like, when the clerk inserts bills into the inlet 12, the condition is then sensed by the sensor 30 (step 111). When the clerk depresses the start key 16 or 17, the drive mechanism 82 starts operations thereof such that the push plate 31 is moved toward the receive plate 34 so as to push the inserted bills against the receive plate 34 and to effect a rotation drive operation on the fetch rollers 35 and 36 and the pinch roller 38, which causes the inserted bills to be fetched into the inside portion of the bill deposit and dispense machine in a sheet-by-sheet fashion (step 112). In this operation, the coil spring 39 closes the opening of the inlet 12 so as to prevent the insertion of bills. The fetched bills are judged for the truth and falsehood and for the kinds of bills in the identifying section 25 as described above and are then reserved in the temporary reserve section 26 (step 113). Unacceptable bills are returned to the outlet 13; in consequence, if necessary, the clerk can insert the rejected bills again into the inlet 12.

In any cases, when all bills inserted into the inlet 12 are fetched and are reserved in the temporary reserve section 26 (step 114), it is indicated on the display 15 that bills for the next transaction may be inserted into the inlet 12 (step 115). The allowance for the bill insertion may be effected by use of a buzzer or the like. In addition, the push plate 31 is returned to the original position and the roller 35 and the other related components are stopped, which enables the bills to be inserted into the inlet 12.

When the clerk inserts bills, after checking this indication, into the inlet 12 (and then presses the start key 16 or 17), this condition is then sensed by the sensor 30 (step 116); thereafter, the push plate 31 is again moved toward the receive plate 34 so as to keep the inserted bills in the pushed state (step 117). The fetch rollers 35 and 36 and the pinch roller 38 are not subjected to a rotation drive operation. Also in this case, the coil spring 39 closes the opening of the inlet 12, and hence the insertion of bills is prevented.

The insertion of bills for the subsequent transaction may be achieved by the clerk who effected the preceding transaction or by the other clerk. For example, when an insertion of bills is allowed for the subsequent transaction after the left clerk inserts bills and the bills are reserved in the temporary reserve section 26, the clerk on the right side may insert bills into the inlet 12. Which one of the clerks inserts the bills is determined according to the input of the start key depressed at the insertion of the bills.

When the preceding transaction is completed and the bills reserved in the temporary reserve section 26 are stored in the cartridges 21 to 24 (step 118), the system starts an operation to fetch the bills inserted through the inlet 12 and kept pressed as described above, namely, there is effected a drive operation on the rollers 35 and 36 and the like (step 119). Like in the case of the preceding transaction processing described above, the fetched bills are reserved in the temporary resreve section 26 (control returns to the step 113).

In a case where after the allowance of the bill insertion is displayed, if the storage operation of the preceding bills from the temporary reserve section 26 into the cartridges 21 to 24 is completed before a bill is inserted into the inlet (step 120), control leaves this deposit processing routine.

As described above, even prior to the completion of the preceding transaction, if the preceding bills are already reserved in the temporary reserve section 26, the bills for the next transaction can be inserted into the inlet 12; in consequence, it is unnecessary for the clerk to wait for the completion of the preceding transaction with the bills received from the customer kept held in a hand for the next transaction. In addition, since the operation to fetch the bills of the next depositing transaction can be immediately started when the preceding transaction is finished, the bill deposit and dispense machine can be efficiently operated, which enables the processing time of the depositing transaction to be minimized.

I claim:

1. A bill handling apparatus having a bill discharge outlet (13) for discharging instructed kinds of and instructed numbers of bills comprising:

a single bill discharge outlet for shared use by two operators;

at least two receive members (42, 43) respectively disposed at a right side and at a left side of said outlet to receive discharged bills, each of said members being selectively moveable in a forward proceeded direction and a backward retracted direction;

means (16, 17) for inputting data to indicate whether an operator who is to receive the discharged bills is at a left or right position relative to said outlet; and proceed and retract drive means (47, 61, 67, 70, 73, 83, 84) operative in response to the left or right position data inputted from said input means for selectively moving that receive member disposed at a position opposite to the position indicated by the position data forwardly to a proceeded position to tilt bills discharged to said outlet towards one of said operators who is indicated by the position data.

2. A bill handling apparatus according to claim 1 wherein said receive members are arranged to be inclined toward an upward direction extending to the forward direction.

3. A bill handling apparatus according to claim 1 including an insert inlet (12) for receiving bills to be deposited, fetch mechanisms (31, 35) for fetching the bills inserted into said inlet, a temporary reserve mechanism (26) for temporarily reserving the fetched bills, and cartridges (21, 22, 23, 24) for storing therein the temporarily reserved bills wherein said apparatus further comprises:

means (31, 39, 80, 82) for blocking said inlet and prohibiting a further insertion of bills into the insert inlet from a time when a bill is inserted into the inlet to a time when the bill is fetched by said fetch mechanisms and is reserved by said temporary reserve mechanism;

means (80, 82) for removing said blocking means from said inlet when the bill is reserved in said temporary reserve mechanism; and means (15) for reporting that the blocking of said inlet has been removed.

4. A bill handling apparatus according to claim 3 further including:

means (80) for effecting a control operation such that immediately after the bills reserved in said temporary reserve mechanism are stored in said cartridges, a fetch operation is started to fetch bills inserted into said inlet.

5. A bill handling apparatus according to claim 1 further including:

a bill insert inlet (12) disposed to be adjacent to the bill discharge outlet; and a shutter (14) pivotally attached at a position between said discharge outlet and said insert inlet so as to undergo an open and close control operation such that said shutter closes either one of the said discharge outlet and said insert inlet.

6. A bill handling apparatus having an insert inlet (12) for receiving bills to be deposited, fetch mechanisms (31, 35) for fetching the bills inserted into said inlet, a temporary reserve mechanism (26) for temporarily reserving the fetched bills, and cartridges (21, 22, 23, 24) for storing therein the temporarily reserved bills wherein said apparatus further comprises:

means (31, 39, 80, 82) for blocking said inlet and prohibiting an insertion of bills into the insert inlet from a time when a bill is inserted into the inlet to a time when the bill is fetched by said fetch mechanisms and is reserved by said temporary reserve mechanism;

means (80, 82) for removing said blocking means from said inlet when the bill is reserved in said temporary reserve mechanism; and means (15) for reporting that the blocking of said inlet has been removed.

7. A bill handling apparatus according to claim 6 further including:

means (80) for effecting a control operation such that immediately after the bills reserved in said temporary reserve mechanism are stored in said cartridges, a fetch operation is started to fetch bills inserted into said inlet.

8. A bill handling apparatus according to claim 6 further including:

a bill discharging outlet (13) disposed to be adjacent to the bill insert inlet; and a shutter (14) pivotally attached at a position between said discharge outlet and said insert inlet so as to undergo an open and close control operation such that said shutter closes either one of the said discharge outlet and said insert inlet.

* * * * *